United States Patent [19]

Saito

[11] 3,947,646

[45] Mar. 30, 1976

[54] RESILIENT MICROPHONE MOUNTING

[75] Inventor: Shoichi Saito, Tokyo, Japan

[73] Assignee: Olympus Optical Company Ltd., Tokyo, Japan

[22] Filed: Apr. 1, 1975

[21] Appl. No.: 564,031

[30] Foreign Application Priority Data

Oct. 11, 1974 Japan ..... 49-122584[U]
Feb. 13, 1975 Japan ..... 50-20095[U]

[52] U.S. Cl. ..... 179/146 R
[51] Int. Cl.[2] ..... H04R 1/28
[58] Field of Search ..... 179/146 R

[56] References Cited

UNITED STATES PATENTS 3,692,264 9/1972 Burkhard et al. ..... 179/146 R

*Primary Examiner*—William C. Cooper
*Attorney, Agent, or Firm*—Ostrolenk, Faber, Gerb & Soffen

[57] ABSTRACT

A microphone holder essentially comprises a microphone supporting cylinder for mounting a microphone therein, an attaching cylinder located outside the supporting cylinder, and a stepped connecting cylinder for connecting the supporting and attaching cylinders together, all of which are integrally formed of a resilient material to support the microphone in suspension, thereby isolating it against oscillations which may be imparted thereto.

10 Claims, 12 Drawing Figures

RESILIENT MICROPHONE MOUNTING

BACKGROUND OF THE INVENTION

The invention relates to a microphone holder, and more particularly to a microphone holder for use in an electrical instrument which internally houses a microphone.

In electrical instruments such as tape recorders which internally house a microphone, an inconvenience is experienced in that oscillations from an electric motor or other rotating members may be transmitted through the body of such instruments to the microphone to cause a noise therefrom.

To overcome such an inconvenience, there has been proposed a microphone holder including a microphone supporting cylinder which is mechanically associated with an externally located attaching cylinder, both integrally formed of a resilient material such as rubber. The use of such a microphone holder maintains the microphone which is fitted inside the supporting cylinder in suspension within the attaching cylinder, and produces a substantially improved isolation against oscillations which may be transmitted through the body of the instruments by virtue of the resilience of the component parts of the holder as well as the effect of double structure comprising the supporting and attaching cylinders. However, with the microphone holder thus constructed, the transmission of an amount of oscillations, though reduced, remains, and therefore, has a significant influence upon the performance, and particularly, the performance of a highly sensitive microphone.

SUMMARY OF THE INVENTION

It is an object of the invention to provide a microphone holder which includes a stepped connecting cylinder located intermediate and interconnecting the microphone supporting cylinder and the attaching cylinder to thereby produce complete isolation of the microphone against oscillations which may be transmitted thereto.

In accordance with the invention, there is provided a stepped connecting cylinder which presents a high resistance to the transmission of oscillations, and hence the possibility of the microphone producing noises in response to transmitted oscillations can be substantially eliminated. In the microphone holder of the invention, the stepped connecting cylinder increases the length of a path from the microphone supporting cylinder to the anchorage of the attaching sleeve and thus provides an increased buffering path length. Also an additional air gap is created between the connecting cylinder and the microphone, which substantially improves the oscillation isolating effect.

Moreover, the oscillation isolating effect can be further increased by providing at least one reinforcing structure, which may comprise an oscillation absorbing structure and/or a reduced wall thickness structure at a suitable location of the microphone holder.

DETAILED DESCRIPTION OF THE PREFERRED EMBODIMENTS

Figure 1:
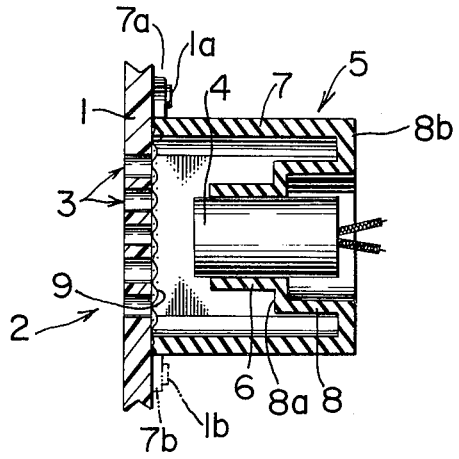
FIG. 1 is a cross section of the microphone holder constructed in accordance with one embodiment of the invention and illustrating the manner of its attachment to an electrical instrument.

Referring to FIG. 1, there is shown a body portion 1 of an electrical instrument such as a tape recorder which internally houses a microphone. The body portion is provided with a grid assembly 2 of a conventional design having a number of perforations 3 for collecting sound and transmitting it to a microphone 4 which is located inside thereof and carried by a microphone holder 5.

The microphone holder 5 essentially comprises a microphone supporting cylinder 6, an attaching cylinder 7 which is located outside the supporting cylinder 6, and a stepped connecting cylinder 8 which connects the cylinders 6, 7 together, all of which are integrally moulded from a resilient material such as rubber, neoprene rubber, elastic plastics or the like.

Figure 2:
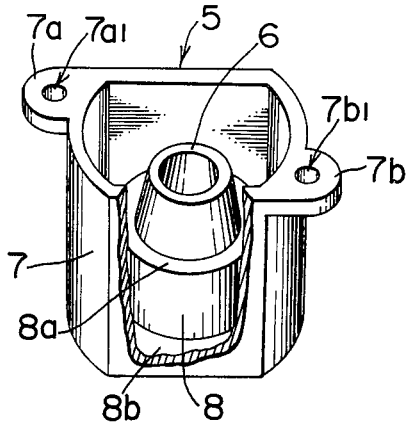
FIG. 2 is a partially sectionalized perspective view of the microphone holder shown in FIG. 1.

At its one end nearer the connecting cylinder 8, the microphone supporting cylinder 6 has an inner diameter which is equal to the outer diameter of the microphone 4 fitted therein, and the entire cylinder 6 is tapered forwardly or toward the grid assembly (see FIG. 2). The connecting cylinder 8 includes a step **8*a* lying in a single plane and connected with the end of the microphone supporting cylinder 6 which is remote from the grid assembly and a base 8*b* which is connected with the free end of the attaching cylinder 7**.

The attaching cylinder 7 is in a configuration folded back from the connecting cylinder 8 and is located externally of the microphone supporting cylinder 6. The attaching cylinder 7 is provided with a pair of diametrically opposite tabs **7*a*, 7*b* having apertures 7*a*1, 7*b*1 therein. These apertures are engaged by a pair of pegs or joggles 1*a*, 1*b* integral with the body portion 1, the top of the joggles being swaged to secure the microphone holder 5 inside the grid assembly 2. Where the body portion 1 is formed of a plastic material, the joggles 1*a*, 1*b* can be heat swaged. However, it should be understood that for a body portion formed of a plastic or metal material, the holder 5 can be secured to the body portion by any other conventional means such as adhesion, threaded connection or crimping. It will be noted that a screen 9 comprising a meshwork, a cloth, a porous non-woven fabric of foamed polyurethene or the like is applied on the inner surface of the grid assembly 2. The screen 9 may be interposed between the body portion 1 and the attaching sleeve 7** to further increase the oscillation isolating effect.

FIGS. 3 to 12 illustrate other embodiments of the invention. In the description to follow, it should be understood that the parts having the same function as those illustrated in FIGS. 1 and 2 are designated by like characters without repeating their description.

Figure 3:
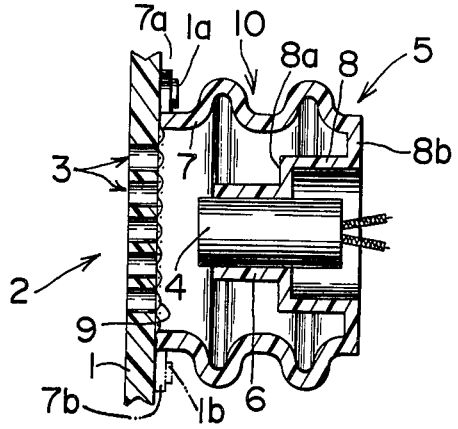
FIGS. 3 and 4 are cross sections of other embodiments of the invention.

In FIG. 3, the microphone holder 5 includes bellows 10 formed in the attaching cylinder 7 so as to serve as a buffering member.

Figure 4:
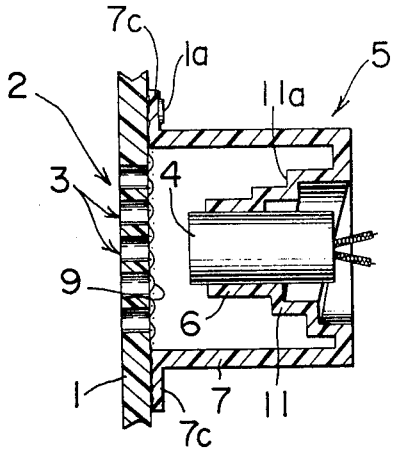
Figure 5:
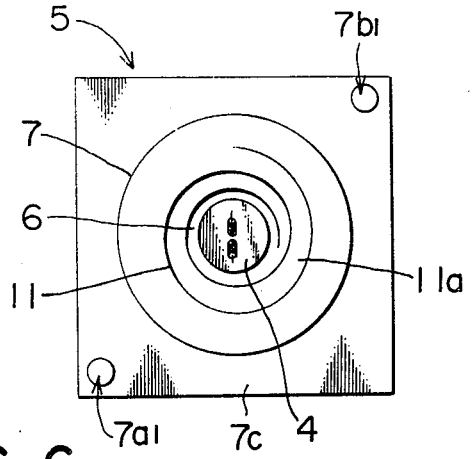
FIG. 5 is a side elevation of the microphone holder shown in FIG. 4, as viewed from the right-hand side of FIG. 4.
Figure 6:
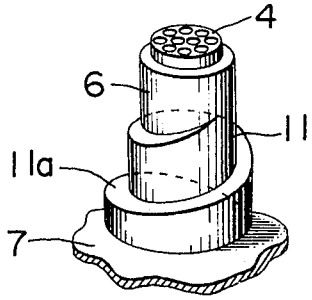
FIG. 6 is a perspective view of a stepped connecting cylinder.

In FIGS. 4 to 6, the microphone holder 5 includes a modified connecting cylinder 11 which is provided with a helical step 11*a*. The helical construction of the step 11*a* serves as a reinforcing structure, whereby the wall thickness of the connecting cylinder 11 can be reduced without impairing its strength to hold the microphone 4. In addition, this configuration facilitates the removal of a moulded product from a mould used and prevents damage to the product. In this instance, the attaching cylinder 7 is provided with a surrounding square flange 7*c* having a pair of mounting holes 7*a*1, 7*b*1 at its diametrical corners.

Figure 7:
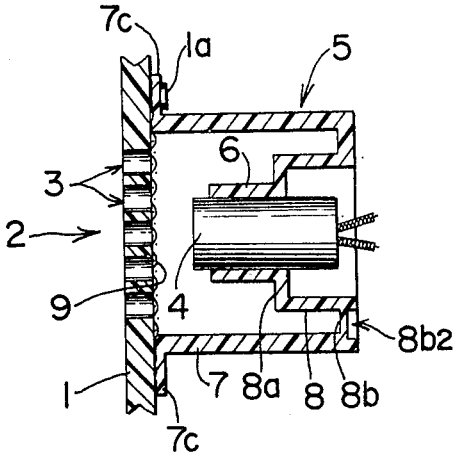
FIG. 7 is a cross section of a microphone holder constructed in accordance with an additional embodiment of the invention.
Figure 8:
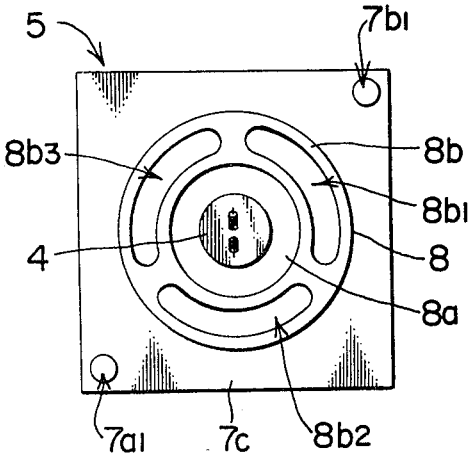
FIG. 8 is a side elevation of the microphone holder shown in FIG. 7, as viewed from the right-hand side thereof.

In FIGS. 7 and 8, the connecting cylinder 8 is connected with the microphone supporting cylinder 6 at its one end 8a and is also connected with the attaching cylinder 7 at its other end or bottom 8*b*. Spaced recesses 8*b*1, 8*b*2 and 8*b*3 are formed in the bottom 8*b* to reduce its thickness, and the portions of the bottom which are located between these recesses have an increased thickness to serve as a reinforcing structure.

Figure 9:
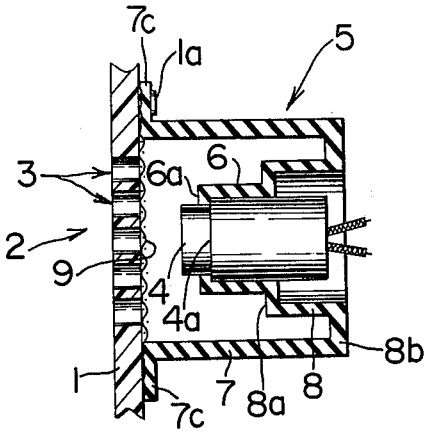
FIGS. 9 to 11 are cross sections illustrating further embodiments of the microphone holder of the invention.

In FIG. 9, the microphone 4 is formed with a step 4*a* at its left-hand end which is engaged by a stepped detent 6*a* formed at the forward end of the microphone supporting cylinder 6. The stepped detent 6*a* serves as a reinforcing structure and also as a stop when fitting the microphone 4 into the supporting cylinder 6. The detent 6*a* prevents a displacement of the microphone 4 as a result of oscillations which may be imparted thereto.

Figure 10:
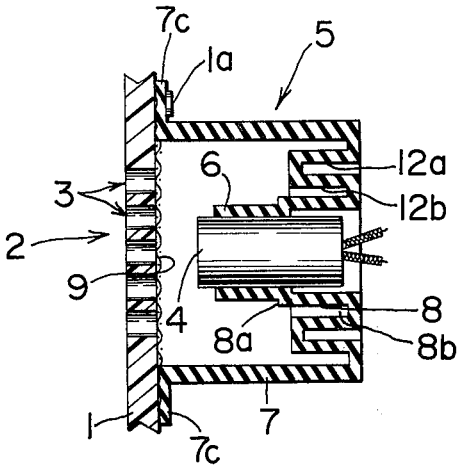

In the arrangement of FIG. 10, a pair of oscillation absorbing interconnected cylinders 12*a*, 12*b* are arranged between and integrally connected with the attaching cylinder 7 and the connecting cylinder 8. Increasing the number of connecting cylinders in this manner achieves a very satisfactory isolation of oscillations in that they constitute together an oscillation absorbing structure by themselves and also increase the buffering path which the oscillations must travel before being transmitted to the microphone.

Figure 11:
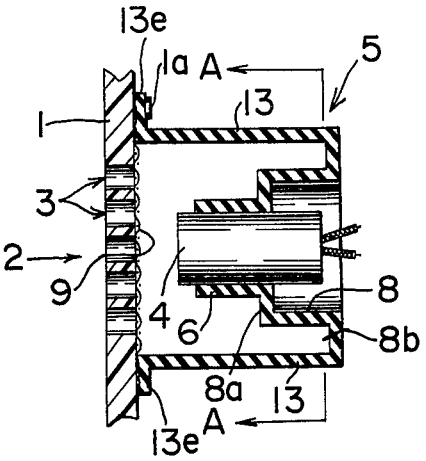
Figure 12:
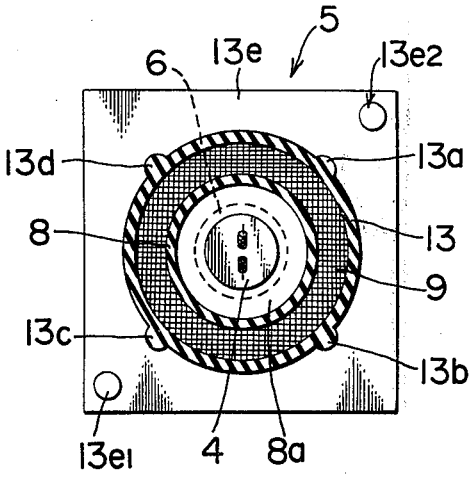
FIG. 12 is a cross section of the microphone holder taken along the line A—A of FIG. 11.

In FIGS. 11 and 12, there is shown an arrangement of the microphone holder 5 using a modified attaching cylinder 13. The attaching cylinder 13 is provided with four semicylindrical ribs 13*a*, 13*b*, 13*c* and 13*d* which are equiangularly spaced around the outer periphery and extend the length of the attaching cylinder 13. The remainder of the attaching cylinder 13 has a reduced wall thickness. It will be appreciated that the ribs 13*a*, 13*b*, 13*c* and 13*d* reinforce the overall structure, thereby permitting a reduction in the wall thickness of the cylinder. The attaching cylinder 13 is provided with a surrounding square flange 13*e* in which a pair of mounting holes 13*e*1, 13*e*2 are formed at diametrically opposite corners thereof.

In accordance with the invention, any of the reinforcing structures, the oscillation absorbing structures and/or the reduced thickness structure can be used either alone or in combination at a suitable location of the microphone holder 5. It will be appreciated by one skilled in the art that the configuration of the mounting tabs or flanges of the attaching cylinders and the number of mounting holes, the number and extent of undulations in the bellows, the number of turns in the helical step of the microphone supporting cylinder, the number as well as the width and depth of the recesses formed in the connecting cylinder, the number of connecting cylinders used, or the size and the number of cylindrical ribs on the attaching cylinder is a matter of design.

What is claimed is:

1. A microphone holder for use in an electrical instrument which internally houses a microphone, comprising a microphone supporting cylinder for mounting a microphone therein, a microphone attaching cylinder located outside the microphone supporting cylinder, and a stepped connecting cylinder for connecting the supporting and mounting cylinders together, all of the cylinders being integrally formed of a resilient material.

2. A microphone holder according to claim 1 in which the connecting cylinder has a step lying in a single plane.

3. A microphone holder according to claim 1 in which the microphone supporting cylinder is tapered toward its end which is remote from the other end where the tapered cylinder is integrally joined to the connecting cylinder.

4. A microphone holder according to claim 1, further including at least one of a reinforcing structure, an oscillation absorbing structure and a reduced thickness structure located at a suitable position on the microphone holder.

5. A microphone holder according to claim 4 in which the reinforcing structure comprises a stepped detent formed on the microphone supporting cylinder.

6. A microphone holder according to claim 4 in which the reinforcing structure comprises a helical step formed in the connecting cylinder.

7. A microphone holder according to claim 4 in which the reinforcing structure comprises a cylindrical formation on the microphone attaching cylinder and having an increased thickness.

8. A microphone holder according to claim 4 in which the oscillation absorbing structure comprises bellows formed in the microphone attaching cylinder.

9. A microphone holder according to claim 4 in which the oscillation absorbing structure comprises a plurality of interconnected, connecting cylinders.

10. A microphone holder according to claim 4 in which the reduced thickness structure comprises a recess formed in that end of the connecting cylinder which is remote from the other end where the connecting cylinder is connected with the supporting cylinder.

* * * * *